US007878863B2

(12) United States Patent
Johansson et al.

(10) Patent No.: US 7,878,863 B2
(45) Date of Patent: Feb. 1, 2011

(54) CONNECTOR SYSTEM WITH DATA COMMUNICATION SYSTEM USING INDUCTION AND METHOD

(75) Inventors: David Johansson, Malmo (SE); Markus Agevik, Malmo (SE); Anders Lundquist, Malmo (SE); Anders Hansson, Klagerup (SE)

(73) Assignee: Sony Ericsson Mobile Communications AB, Lund (SE)

( * ) Notice: Subject to any disclaimer, the term of this patent is extended or adjusted under 35 U.S.C. 154(b) by 232 days.

(21) Appl. No.: 11/872,966

(22) Filed: Oct. 16, 2007

(65) Prior Publication Data

US 2009/0098780 A1 Apr. 16, 2009

Related U.S. Application Data

(60) Provisional application No. 60/979,741, filed on Oct. 12, 2007.

(51) Int. Cl.
*H01R 24/04* (2006.01)

(52) U.S. Cl. ..... 439/668; 439/950

(58) Field of Classification Search ..... 439/668, 439/950

See application file for complete search history.

(56) References Cited

U.S. PATENT DOCUMENTS

| | | | | |
|---|---|---|---|---|
| 3,969,673 A | | 7/1976 | Nordlof | |
| 3,995,209 A | | 11/1976 | Weston | |
| 5,385,476 A | * | 1/1995 | Jasper | 439/38 |
| 5,488,352 A | | 1/1996 | Jasper | |
| 6,866,306 B2 | | 3/2005 | Boyle et al. | |
| 2006/0166719 A1 | * | 7/2006 | Arad et al. | 455/575.2 |

FOREIGN PATENT DOCUMENTS

| | | |
|---|---|---|
| JP | 2003 229215 | 8/2003 |
| JP | 2004 039389 | 2/2004 |

OTHER PUBLICATIONS

International Search Report corresponding to PCT/IB2008/000686, mailed Nov. 3, 2008.
Written Opinion corresponding to PCT/IB2008/000686, mailed Nov. 3, 2008.

* cited by examiner

*Primary Examiner*—Truc T Nguyen
(74) *Attorney, Agent, or Firm*—Renner, Otto, Boisselle & Sklar, LLP

(57) ABSTRACT

An electrical connector provides both electrically conductive connection and inductive connection, and includes at least one electrically conductive member adapted to provide electrically conductive connection to another electrically conductive member, an inductive electrical member adapted to provide inductive coupling with another inductive electrical member, and wherein the at least one electrically conductive member and the inductive electrical member being held in positional relation to each other to be positioned with respect to a further electrical connector for electrically conductive connection and inductive coupling with respect thereto. A method of connecting electrical signals uses a pair of electrical connectors, each having an electrically conductive connection portion and an inductive connection portion to provide for both electrically conductive connection and inductive coupling between the electrical connectors.

16 Claims, 2 Drawing Sheets

CONNECTOR SYSTEM WITH DATA COMMUNICATION SYSTEM USING INDUCTION AND METHOD

CROSS-REFERENCE TO RELATED APPLICATION

This application claims the benefit of U.S. Provisional Patent Application Ser. No. 60/979,741, filed Oct. 12, 2007, the entire disclosure of which is hereby incorporated by reference.

TECHNICAL FIELD

The present invention relates generally, as indicated, to connector system with data communication system using induction and method, and to electronic equipment using both electrically conductive signal connections and inductive signal connections and method, and, more particularly, to portable electronic equipment and method using electrical connectors providing electrical signal connections and also inductive coupling of signals in respective signal paths and method.

BACKGROUND

Mobile and/or wireless electronic devices are becoming increasingly popular. For example, mobile telephones, portable media players and portable gaming devices are now in wide-spread use. In addition, the features and accessories associated with certain types of electronic devices have become increasingly diverse. To name a few examples, many electronic devices have cameras, text messaging capability, Internet browsing capability, electronic mail capability, video playback capability, audio playback capability, image display capability and handsfree headset interfaces. Exemplary accessories may also include headphones, music and video input players, etc.

Many mobile and/or wireless electronic devices include audio connectors to which accessories, such as, for example, handsfree headsets, headphones, etc. may be connected. Audio connectors and other type of connectors for such devices usually include one or more terminals or terminal portions of respective wires or of printed circuit traces, or the like via which electrical signals are conducted between a connector of the mobile phone, for example, and the connector of the accessory, for example. Sometimes it would be desirable to conduct more signals and/or to provide greater bandwidth for coupling between such electronic devices and accessories than was heretofore possible using standard electrical connectors.

As an example, some audio connectors of portable electronic devices have used five pins or five electrical paths for connection with corresponding pins or electrical paths of the accessory connector of an accessory, and a substantial amount of data, signals, etc. may be transferred via connectors and such connection paths. However, if the number of conductive paths, e.g., the number of pins and/or electrically conductive traces, wires, terminals, etc., were reduced, the amount of data, signals, etc. that could be transferred between the electronic device and accessory may be reduced. For example, a new electrical connector, sometimes referred to as a 3.5 millimeter connector, may have four electrically conductive paths rather than five paths that have been available in other connectors that have been used for similar purposes, e.g., audio signal connection, etc.

SUMMARY

Briefly, in accordance with one aspect of the present invention an inductive connection is provided in conjunction with an electrical connector that provides electrically conductive connection for an electronic device.

In accordance with another aspect, a method includes transferring signals between an electronic device and an accessory via one or more electrically conductive paths and additionally transferring signals inductively via an inductive path, which may be separate from the one or more electrically conductive paths.

According to another aspect, an electrical connector provides both electrically conductive connection and inductive connection and includes at least one electrically conductive member adapted to provide electrically conductive connection to another electrically conductive member, an inductive electrical member adapted to provide inductive coupling with another inductive electrical member, and the at least one electrically conductive member and the inductive electrical member being held in positional relation to each other to be positioned with respect to a further electrical connector for electrically conductive connection and inductive coupling with respect thereto.

Another aspect relates to such connector, further comprising the further electrical connector, the further electrical connector including at least a one further electrically conductive member adapted to connect by electrical conduction with said at least one electrically conductive member, and a further inductive electrical member adapted to connect by inductive coupling to said inductive electrical member.

Another aspect relates to such connector, further comprising a support adapted to support both the at least one electrically conductive member and the inductive electrical member in positional relation to each other.

Another aspect relates to such connector, said electrical connector comprising an audio connector connectable with an audio connector of an electronic device.

Another aspect relates to such connector, said electrical connector comprising an audio connector of an electronic device.

Another aspect relates to such connector wherein the electronic device is a portable electronic device.

Another aspect relates to such connector wherein the portable electronic device includes operating circuitry, and wherein both the at least one electrically conductive member and the inductive electrical member are electrically connected to said operating circuitry.

Another aspect relates to such connector wherein the portable electronic device includes an electromagnetic energy shield to prevent disturbance of audio signals, and wherein the inductive electrical member is outside the shield to prevent disturbance on audio signals.

Another aspect relates to such connector wherein the at least one electrically conductive member is adapted to provide electrically conductive connection of audio signals, further comprising a shield to prevent disturbance on audio signals, and wherein the inductive electrical member is outside the shield to prevent disturbance on audio signals.

Another aspect relates to a connection system for signals, including an electrically conductive connector adapted to connect electrical signals by electrical conduction, and an inductive electrical connector adapted to connect signals via induction substantially independently of the electrically conductive connector, and both the electrically conductive connector and the inductive connector being supported in substantially fixed positional relation to each other.

Another aspect relates to such connection system, further comprising a support, the support comprising a female housing to receive a male plug, the male plug including one part of the electrically conductive connector and the female housing including another part of the electrically conductive connector, whereby with the male plug inserted in the female housing the one part and the other part of the electrically conductive connector engage and are electrically connected.

Another aspect relates to such connection system wherein the inductive electrical connector comprises an inductive member positioned in proximity to the female housing support and another inductive member positioned in proximity to the male plug, the inductive members being so positioned such that with the male plug inserted in the female housing the inductive members are in relation for inductive coupling of signals provided in one of the inductive members to the other inductive member.

Another aspect relates to such connection system, each of said inductive members comprising an inductive coil.

Another aspect relates to such connection system, further comprising a coil support to hold one inductive coil outside the female housing support and generally circumscribing the axis of the female housing opening into which the male plug may be inserted.

Another aspect relates to such connection system, said male plug having a housing providing support for the other inductive member in generally circumscribing relation to the axis of the male plug.

Another aspect relates to a portable electronic device including a connection system for signals, including an electrically conductive connector adapted to connect electrical signals by electrical conduction, and an inductive electrical connector adapted to connect signals via induction substantially independently of the electrically conductive connector, and both the electrically conductive connector and the inductive electrical connector being supported in substantially fixed relation to each other.

Another aspect relates to such portable electronic device wherein said connector system comprises a system for connecting audio signals by electrical conduction. p Another aspect relates to such portable electronic device, comprising a mobile phone.

Another aspect relates to a method of connecting electrical signals, including using a pair of electrical connectors, each having an electrically conductive connection portion and an inductive connection portion, providing both electrically conductive connection and inductive coupling between the electrical connectors.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "comprises/comprising" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment.

DESCRIPTION

The interchangeable terms "electronic equipment" and "electronic device" include portable radio communication equipment. The term "portable radio communication equipment," which hereinafter is referred to as a "mobile radio terminal," as "portable electronic equipment," or as a "portable communication device," includes all equipment such as mobile telephones, pagers, communicators, electronic organizers, personal digital assistants (PDAs), smartphones, portable communication apparatus or the like.

In the present application, embodiments of the invention are described primarily in the context of a mobile telephone. However, it will be appreciated that the invention is not intended to be limited to the context of a mobile telephone and may relate to any type of appropriate electronic equipment, examples of which include a media player, a gaming device, PDA and a computer, etc.

Figure 1:
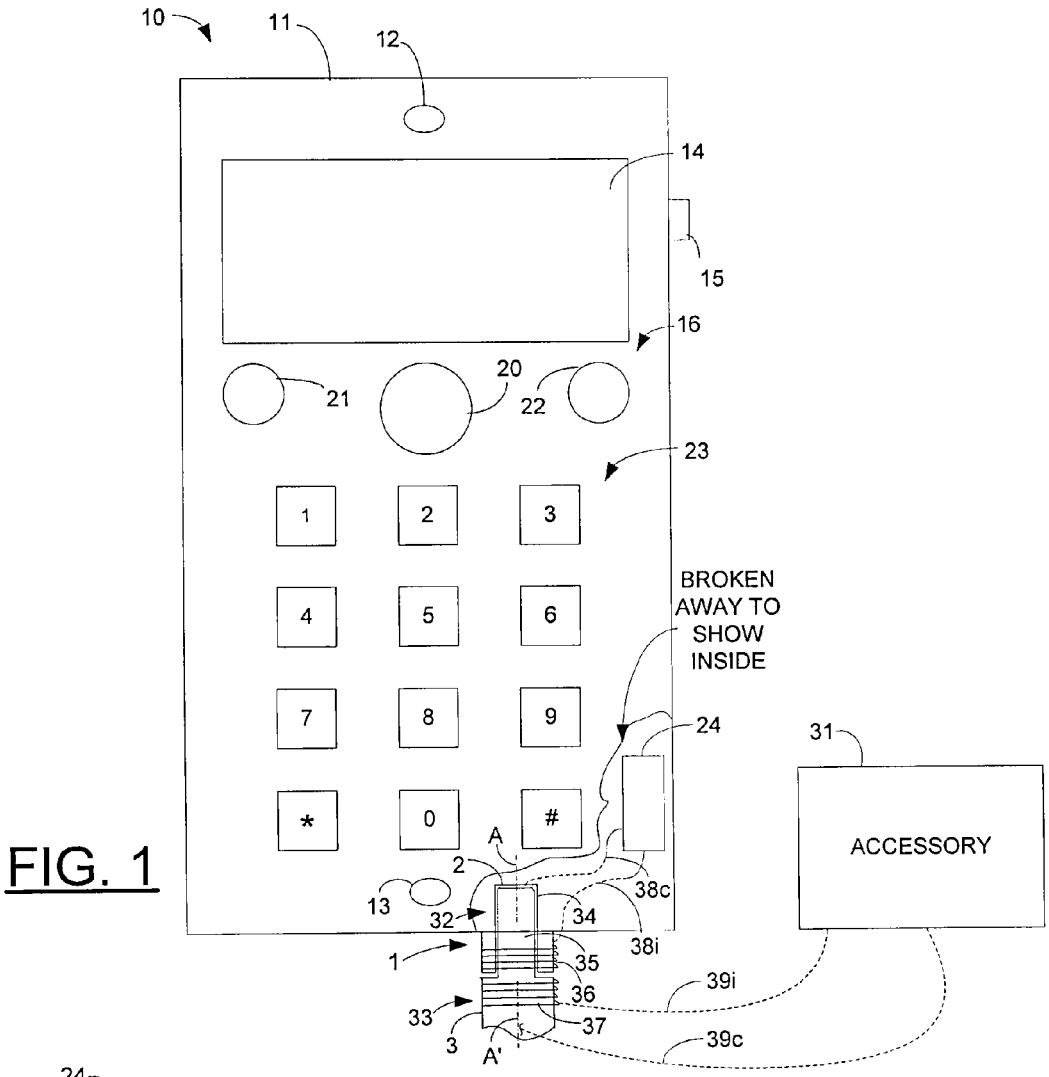
FIG. 1 is a schematic illustration of the front of a portable communication device, e.g., in the form of a mobile phone.
Figure 3:
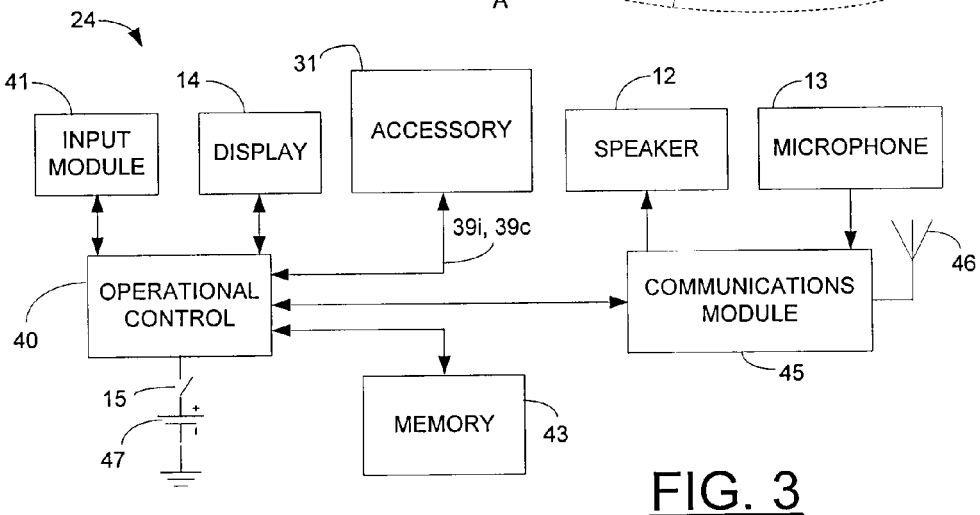
FIG. 3 is a schematic block system diagram of circuitry of the mobile phone of FIG. 1 for carrying out operation thereof in a manner described below.
Figure 2:
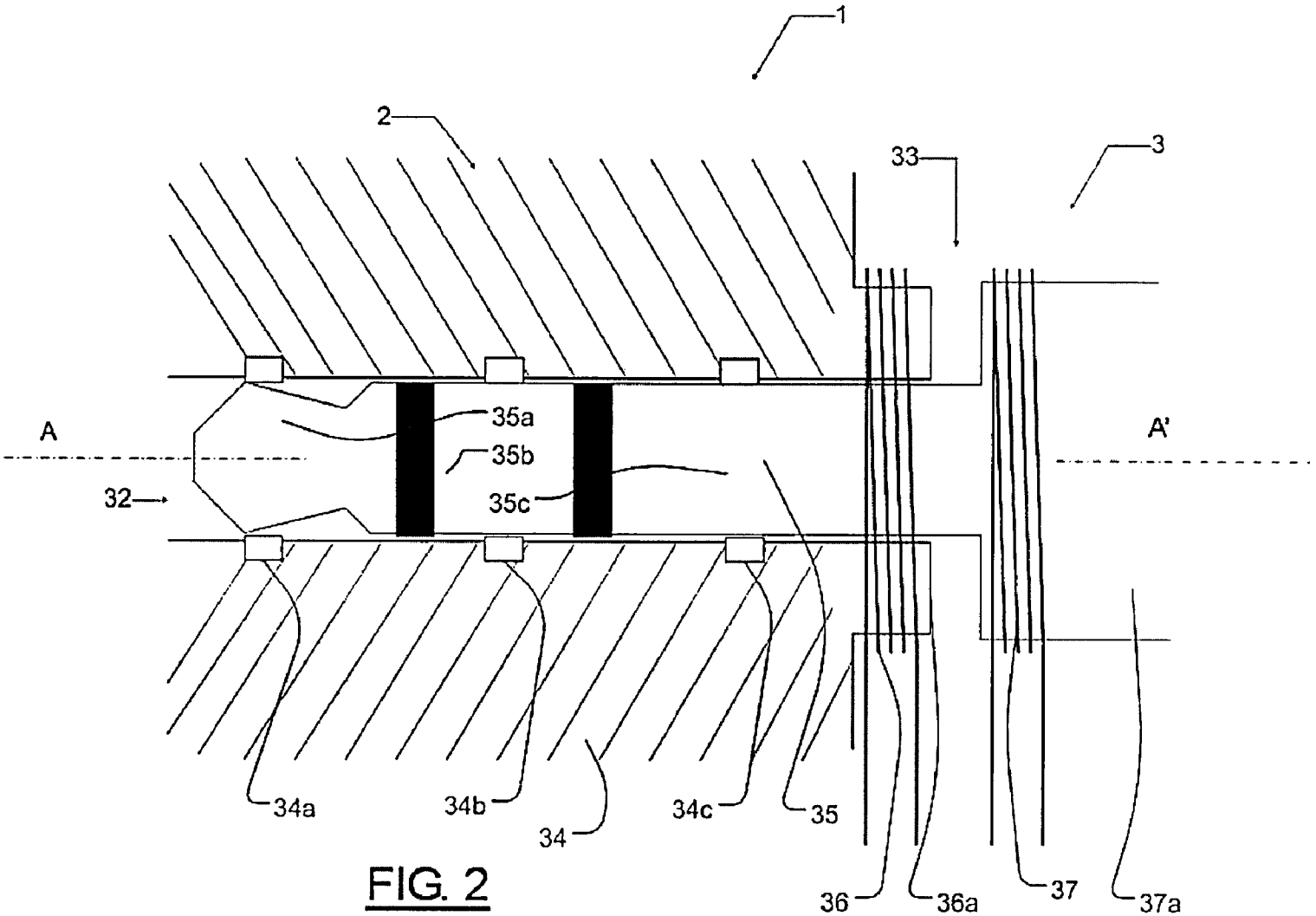
FIG. 2 is an enlarged fragmentary view of a connector system having conductive and inductive connection features.

In FIGS. 1-3, as is described in greater detail below, an electrical connector system 1 includes two connector parts, 2, 3 that may be connected together to provide both electrically conductive connection of respective electrically conductive terminals or the like and also inductive electrical coupling or connection of respective inductors. Thus, electrical connection between the two parts 2, 3 of the electrical connector system 1 is provided by electrical conduction and by induction.

Referring in further detail to the FIGS. 1 and 2, a portable communication device in accordance with an embodiment of the present invention is illustrated generally at 10. The portable communication device 10 will be referred to below as a mobile phone. However, as was mentioned above, reference to "mobile phone" includes various other devices, such as, for example, those mentioned above. In outward appearance, for example, as is illustrated in FIG. 1, the mobile phone is of one type of design or style; however, the features of the invention, as are described in further detail below, may be used in other types of mobile phones, such as those that include cases that open and close (sometimes referred to as a "flip phone"), and various other mobile phones that currently exist or may come into existence in the future.

The mobile phone 10 includes case (housing) 11, speaker 12, microphone 13, display 14, e.g., liquid crystal display, light emitting diode display, or other display, on/off switch 15, and a number of keys generally indicated at 16. The keys 16 may include a number of keys having different respective functions. For example, the key 20 may be a navigation key, selection key or some other type of key; the keys 21, 22 may be, for example, soft switches or soft keys; and the keys 23 may be dialing keys. As an example, the navigation key may be used to scroll through lists shown on the display 14, to select one or more items shown in a list on the display 14, etc. The soft switches 21, 22 may be manually operated to carry out respective functions, such as those shown or listed on the display 14 in proximity to the respective soft switch or selected by the navigation key 20, etc. The dialing keys 23 may be used to dial a telephone number or to input alphanumeric or other data. The speaker 12, microphone 13, display 14, and keys 16 may be used and function in the usual ways in which a mobile phone typically is used, e.g. to initiate, to receive and/or to answer telephone calls, to send and to receive text messages, to connect with and carry out various functions via a network, such as the Internet or some other network, to beam information between mobile phones, etc. These are examples; there may be other uses that currently exist or may exist in the future. The mobile phone 10 also includes operating circuitry 24 that responds to programming and to inputs, e.g., provided by a user pressing a key or applying a stylus or finger to a touch-sensitive screen, etc. or provided from an external source, such as an incoming telephone call or text message, to carry out functions of the mobile phone. As is seen in FIG. 1, part of the housing of the mobile phone is broken away to show an interior portion of the housing, including the operating circuitry 24 and the electrical connector system 1.

The electrical connector system 1 connects the mobile phone 10, e.g., the operating circuitry 24 thereof, with another device, e.g. an accessory 31, a remote device, etc. Such electrical connector system 1 provides for both electrically conductive connection by an electrically conductive portion 32 and inductive coupling by an inductive electrically coupling portion 33. The connector system 1 may be in the general form of an audio connector including both a female housing (sometimes referred to as a receptacle) 34 and a male plug 35 that is intended to plug into the female housing. The female housing 34 and male plug 35 may include, respectively, one or more electrically conductive members or parts 34*a*-34*c* and 35*a*-35*c*, e.g., wires, terminals, electrically conductive traces, etc. that respectively connect to each other by physical engagement and, thus, provide electrically conductive connection when the male plug is plugged into the female housing. The female housing has an axis A and the male plug has an axis A' and the two axes align generally congruently, for example, when the male plug is inserted into the female housing.

The inductive electrically coupling portion 33 of the connector system includes inductors 36, 37 (sometimes referred to herein as coils) that are oriented in relation to respective axes A, A' so as generally to circumscribe the respective axes, as is illustrated in FIGS. 1 and 2. The inductors 36, 37 may be respective electrically conductive wires or printed circuit traces, etc. The inductors 36, 37 may be wrapped, coiled, positioned, etc. about respective axes A, A'.

As is illustrated, the coil 36 may be wrapped about a hollow cylindrical extension 36*a* of the female housing 34, and the coil 37 may be wrapped about a housing portion 37*a* of the male plug 35. A covering may be provided about the respective coils, as may be desired, to provide electrical insulation and/or physical protection and/or to block inductive leakage (or electrical noise) in undesired directions.

It will be appreciated from the illustrations and description that the conductive and inductive portions 32, 33 of the connector part 2, e.g., the female housing 34, are supported by the connector housing 36*a* so as not to interfere with each other and so as to couple with the respective conductive and inductive portions 32, 33 of the other connector part 3, e.g., the male plug 35. The conductive and inductive portions of the male plug 35 also are supported by the male plug housing 37*a* or the like for similar reasons. Accordingly, the respective conductive and inductive portions of the connector parts 2, 3 are supported or otherwise retained in generally fixed positional relation with respect to each other to avoid interfering with each other electrically or mechanically and to allow for electrical and inductive connection with the conductive and inductive portions of the other connector part.

The extension 36*a* of the female housing 34 and the housing portion 37*a* of the male plug 35 may be of a material that provides electromagnetic energy shielding so that signals in the coils 36, 37 would not interfere with or otherwise disturb audio or other signals that are carried by or connected by the electrically conductive portion 32 of the connector system 1. The material of the housing 11 also may provide shielding for similar purposes, if desired.

With the male plug 35 plugged into the female housing 34, such that the respective pairs of electrically conductive members 34*a*-34*c* and 35*a*-35*c* are engaged and electrically connected for conduction, the coils 36, 37 are positioned in relatively close proximity to each other to establish an inductive coupling between the coils when suitable signals are provided, thereby to connect signals in one coil to the other coil.

Connective paths 38*c*, 38*i*, e.g., wires, conductive traces on printed circuit boards, etc., from respective electrically conductive portions 32 and inductive electrically coupling portion 33 are provided to the operating circuitry 24 of the mobile phone 10. Electrically conductive paths 39*c*, 39*i*, e.g., wires, conductive traces on printed circuit boards, etc., are provided to the accessory, remote device, etc. 31 from the electrically conductive portion 32 and the inductive electrically coupling portion 33. Thus, connection can be provided by the electrical connector 1 using both conduction and inductive coupling techniques. Such connection using both conduction and induction allows for increased amount of signal transmission or bandwidth, etc.

Summarizing, the invention provides for transmitting data between an accessory and an electronic device, e.g., portable electronic equipment, such as a mobile phone, via an electrical connector that is similar in size and shape to an audio connector or audio jack. The approach may be used with conventional audio jacks or connectors and/or with other connectors whether or not of the audio type. The approach may be used with a 3.5 millimeter audio jack that may provide for fewer electrically conductive connections than other audio jacks. Induction is used to transmit data between the audio jack (e.g., the female housing part of the connector system mentioned above) and the male plug. By changing the current in the transmitter coil 36 or 37, there will be an induced signal in the receiver coil, e.g., the other of the coils 37 or 36. This induced signal may be used to transmit data. The coils may be placed outside the shield of the electronic device and/or of the male plug to prevent disturbance on the audio signal.

Exemplary accessories may be headsets, mono or stereo headphones, external amplifier(s) and/or speaker(s), etc. Other types of accessories may be used with the connector 1 and mobile phone 10 to receive outputs from the connector and/or to provide inputs to the connector.

Turning to FIG. 3, a schematic block system diagram of operating circuitry 24 of the mobile phone 10 is illustrated. The illustration is exemplary; other types of circuitry may be employed in addition to or instead of the operating circuitry 24 to carry out the various functions of a mobile phone and the various functions described in detail herein. The operating circuitry includes an operational control 40 that controls the various components of the operating circuitry 24. An input module 41 provides inputs to the operational control 40, such as, for example, inputs from the various keys 16. Inputs also may be provided from the display 14 if it is a touch screen type of display, and inputs also may be provided the input module 41 from other connections to the mobile phone, etc. The display 14 may be a touch screen that provides for inputs to the input module 41 by touching using a finger, a stylus, or some other device, and the result of such touching may be provided as inputs to the operational control 40. The operational control 40 also may operate the display 14 to determine what information, icons, images, etc. is shown on the display 14.

The accessory 31 is coupled to the operating circuitry via the connector system 1. More particularly, the accessory 31 is connected to the operational control 40 of the operating circuitry and operates in response to the operational control 40 and/or in response to receiving other suitable input. The accessory 31 also may provide input to the operating circuitry via the connector system 1.

Electrical power may be provided by the operational control 40 to the accessory 31. Program code in the operating circuitry 24, e.g., stored in the memory 43, may control operation of the operational control 40 to operate the accessory 31. Circuitry in and/or programming in the operating circuitry 24 and/or operational control 40 may determine various operational features of the mobile phone 10 and/or the accessory 31.

As an example, the operational control 40 may be a microprocessor or some other electrical or electronic device that is responsive to various inputs, e.g., input signals, and provides various outputs, e.g., output signals. The operational control 40 may be internally programmed or manufactured in a way to include internal programming thereof to carry out various functions. However, in many instances an operational control 40 of a mobile phone 10 would have associated therewith the memory 43 in which appropriate programming instructions, computer program, logic, etc., may be provided the operational control 40 to carry out the functions thereof. The memory may include identity information concerning respective accessories and settings of the operating circuitry in response to respective identity information. The memory 43 also may include storage for telephone numbers and other information concerning contacts who may be called, messaged, etc. using the mobile phone 10, storage of photographs and/or other data, as often is the capability of such memory in conventional mobile phones, for example, and the memory may be used for other purposes that may come into existence in the future. The memory 43 may be a read only memory, random access memory (RAM), flash RAM, programmable read only memory, or some other memory device. Also associated with the operational control 40 is a timer 44 that can be used to provide timing signals representing increments of time for synchronizing operation of the operating circuitry 24 with some other device, for clock/calendar control functions, and/or for determining amount of time (duration) for the hold on function and/or for a screensaver function.

The operating circuitry 24 also includes a communications module 45 that receives inputs from microphone 13 and provides outputs to the speaker 12, as are common functions in a mobile phone. An antenna 46 may be coupled to the communications module 45 to transmit and to receive signals representing telephone communications, data communications, messages, etc. The communications module 45 may operate under control of the operational control 40 in the usual manner of a mobile phone. Additionally, the communications module 45 may provide an input to the operational control 40 to indicate that there is an incoming telephone call or text message; and in response thereto, the operational control 40 may operate the display 14 in conventional manner, e.g., to indicate an incoming phone call, to show a text message or photograph, etc.

A power supply 47 provides electrical power to the operating circuitry 24 and/or to other parts of the mobile phone 10 via the on/off switch 15. The power supply may be a conventional battery or some other source of electrical power. Upon closing the on/off switch 15, the power is provided the operating circuitry 24 to carry out the various functions described herein, for example. If desired, closing the switch 15 may lead to temporary operation of the display to display a start-up message or indication, and then a power saving feature, e.g., a screensaver function, may be implemented to turn off the display.

Operation of the mobile phone 10 may be under computer program control or the like. Such operation may be as is performed to carry out the functions of a mobile phone. Operation of the accessory 31 may be carried out under computer program control or the like. Such operation also may be as is performed in a conventional manner. The computer programs and computer program control may be carried out by persons who have ordinary skill in the art to prepare and to use such programs and control. New computer program control techniques and methods also may be developed in the future by persons having ordinary skill in the art and may be used in connection with the connector system and mobile phone and accessories.

It will be appreciated that portions of the present invention can be implemented in hardware, software, firmware, or a combination thereof. In the described embodiment(s), a number of the steps or methods may be implemented in software or firmware that is stored in a memory and that is executed by a suitable instruction execution system. If implemented in hardware, for example, as in an alternative embodiment, implementation may be with any or a combination of the following technologies, which are all well known in the art: discrete logic circuit(s) having logic gates for implementing logic functions upon data signals, application specific integrated circuit(s) (ASIC) having appropriate combinational logic gates, programmable gate array(s) (PGA), field programmable gate array(s) (FPGA), etc.

Any process or method descriptions or blocks in flow charts may be understood as representing modules, segments, or portions of code which include one or more executable instructions for implementing specific logical functions or steps in the process, and alternate implementations are included within the scope of the preferred embodiment of the present invention in which functions may be executed out of order from that shown or discussed, including substantially concurrently or in reverse order, depending on the functionality involved, as would be understood by those reasonably skilled in the art of the present invention.

The logic and/or steps represented in the flow diagrams of the drawings, which, for example, may be considered an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The above description and accompanying drawings depict the various features of the invention. It will be appreciated that the appropriate computer code could be prepared by a person who has ordinary skill in the art to carry out the various steps and procedures described above and illustrated in the drawings. It also will be appreciated that the various terminals, computers, servers, networks and the like described above may be virtually any type and that the computer code may be prepared to carry out the invention using such apparatus in accordance with the disclosure hereof.

Specific embodiments of an invention are disclosed herein. One of ordinary skill in the art will readily recognize that the invention may have other applications in other environments. In fact, many embodiments and implementations are possible. The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

We claim:

1. An audio electrical connector to provide both electrically conductive connection of audio signals and inductive connection of signals for a portable electronic device, comprising a plurality of electrically conductive members configured to provide electrically conductive connection of audio signals to or from other respective electrically conductive members, an inductive electrical member configured to provide inductive coupling of signals with another inductive electrical member, a housing, and wherein the housing supports the electrically conductive members in linearly spaced apart relation along an axis such that the electrically conductive members are in electrically separated relation with respect to each other along the axis, and the housing supports the inductive electrical member in positional relation so as not to interfere with the electrically conductive members, and wherein the electrically conductive members and the inductive electrical member are configured to be positioned with respect to a further electrical connector, which has a housing and electrically conductive and inductive coupling portions positioned with respect to such further electrical connector housing along a further axis, for electrically conductive connection and inductive coupling, respectively, to such electrically conductive and inductive coupling portions when the housing and such further electrical connector housing are in position with respect to each other with the axis and further axis in generally congruent relation.

2. The electrical connector of claim 1, further comprising the further electrical connector, one of the electrical connector and the further electrical connector comprising a male plug and the other comprising a female housing, the further electrical connector including a further electrical connector housing, a plurality of further electrically conductive members as such electrically conductive portion including a plurality of further electrically conductive members supported by the further electrical connector housing in linearly spaced apart relation along the further axis and configured to connect by electrical conduction with respective electrically conductive members, and a further inductive electrical member as such inductive coupling portion configured to connect by inductive coupling to said inductive electrical member.

3. The electrical connector of claim 1, the housing comprising a support configured to support both the at least one electrically conductive member and the inductive electrical member in positional relation to each other with the inductive electrical member circumscribing the axis.

4. The electrical connector of claim 1, wherein the portable electronic device includes operating circuitry, and wherein both the at least one electrically conductive member and the inductive electrical member are electrically connected to said operating circuitry.

5. The electrical connector of claim 1, wherein the portable electronic device includes an electromagnetic energy shield to prevent disturbance of audio signals, and wherein the inductive electrical member is outside the shield to prevent disturbance on audio signals coupled by the electrically conductive members.

6. The electrical connector of claim 1, further comprising a shield to prevent disturbance on audio signals, and wherein the inductive electrical member is outside the shield to prevent disturbance on audio signals.

7. A connection system for signals, comprising a housing, an electrically conductive connector configured to connect electrical signals by electrical conduction, the electrically conductive connector including a plurality of electrically conductive terminals that are spaced apart along an axis in electrically separate relation, and an inductive electrical connector configured to connect signals via induction substantially independently of the electrically conductive connector, and both the electrically conductive connector and the inductive connector being supported with respect to the housing and in substantially fixed relation to each other to make connection by electrical conduction and by inductive coupling to another device having an electrically conductive portion with other electrically conductive terminals spaced along another axis and an inductive coupling portion.

8. The connection system of claim 7, wherein the housing comprises a female housing to receive a male plug, the male plug including one part of the electrically conductive connector and the female housing including another part of the electrically conductive connector, whereby with the male plug inserted in the female housing such that the axis and the another axis are generally congruent the one part and the another part of the electrically conductive connector engage and are electrically connected.

9. The connection system of claim 8, wherein the inductive electrical connector comprises an inductive member positioned in proximity to the female housing and another inductive member positioned in proximity to the male plug, the inductive members being so positioned relative to the female housing and the male plug, respectively, such that with the male plug inserted in the female housing providing an electrically conductive connection between the one part and the other part of the electrically conductive connector the inductive members are in positional relation for inductive coupling of signals provided in one of the inductive members to the other inductive member.

10. The connection system of claim 9, each of said inductive members comprising an inductive coil circumscribing a respective axis.

11. The connection system of claim 10, wherein the female housing includes an opening having an axis, and also includes a coil support to hold one inductive coil outside the female housing and generally circumscribing the axis of the female housing opening.

12. The connection system of claim 11, said male plug having an axis, a housing providing support for the other inductive member in generally circumscribing relation to the axis of the male plug, and the male plug and the female housing opening being configured such that the respective axes align in generally congruent relation with the male plug inserted in the female housing opening.

13. A portable electronic device comprising the connector system of claim 7.

14. The portable electronic device of claim 13, comprising a mobile phone.

15. A method of connecting electrical signals, comprising using a pair of electrical connectors, each having an electrically conductive connection portion with a plurality of terminals linearly spaced apart in electrically separated relation along an axis and an inductive coupling portion, inserting at least a part of one electrical connector into at least a part of the other electrical connector to position the electrically conductive portions of the pair of electrical connectors in engagement and respective inductive coupling portions of the pair of electrical connectors in proximity for inductive coupling therebetween to obtain both electrically conductive connection and inductive coupling between the electrical connectors.

16. An electrical connector to provide both electrically conductive connection and inductive connection, comprising a plurality of electrically conductive members in linearly spaced-apart relation to each other along a linear axis and configured to provide electrically conductive connection of signals to other electrically conductive members of another electrical connector, an inductive electrical member configured to provide inductive coupling of signals with another inductive electrical member, the inductive electrical member positioned to circumscribe the axis, a housing, and wherein the plurality of electrically conductive members and the inductive electrical member are held in positional relation to each other and with respect to the housing and are configured to be positioned with respect to the further electrical connector, which has a housing and electrically conductive and inductive coupling portions positioned with respect to such further electrical connector housing, for electrically conductive connection and inductive coupling, respectively, to such electrically conductive and inductive coupling portions when the housing and such further electrical connector housing are in position with respect to each other.

* * * * *